US008915206B1

(12) United States Patent
Herrington et al.

(10) Patent No.: US 8,915,206 B1
(45) Date of Patent: Dec. 23, 2014

(54) T-STEP HULL FORM FOR MONOHULL PLANING VESSELS

(71) Applicants: Frederick Charles Herrington, Cocoa Beach, FL (US); Mark George Hotary, Merritt Island, FL (US); George Benjamin Lewis, Satellite Beach, FL (US)

(72) Inventors: Frederick Charles Herrington, Cocoa Beach, FL (US); Mark George Hotary, Merritt Island, FL (US); George Benjamin Lewis, Satellite Beach, FL (US)

(73) Assignee: Brunswick Corporation, Lake Forest, IL (US)

( * ) Notice: Subject to any disclaimer, the term of this patent is extended or adjusted under 35 U.S.C. 154(b) by 95 days.

(21) Appl. No.: 13/838,834

(22) Filed: Mar. 15, 2013

(51) Int. Cl.
*B63B 1/32* (2006.01)

(52) U.S. Cl.
CPC ..... *B63B 1/32* (2013.01)
USPC ..... 114/290; 114/284; 114/291

(58) Field of Classification Search
USPC ..... 114/284, 285, 288, 290, 291
See application file for complete search history.

(56) References Cited

U.S. PATENT DOCUMENTS

| | | | | |
|---|---|---|---|---|
| 1,832,862 | A | 11/1931 | Grumman | |
| 3,316,874 | A * | 5/1967 | Canazzi | 114/67 A |
| 4,231,314 | A * | 11/1980 | Peters | 114/291 |
| 5,111,767 | A | 5/1992 | Haines | |
| 5,191,853 | A | 3/1993 | Adler | |
| 6,675,736 | B1 * | 1/2004 | Schreiber et al. | 114/290 |
| 7,216,601 | B1 * | 5/2007 | Mann | 114/288 |
| 7,240,632 | B1 * | 7/2007 | Wynne et al. | 114/140 |
| D568,802 | S | 5/2008 | Chen | |

FOREIGN PATENT DOCUMENTS

| | | |
|---|---|---|
| RU | 2161105 | 12/2000 |

* cited by examiner

*Primary Examiner* — Lars A Olson
(74) *Attorney, Agent, or Firm* — Malin Haley DiMaggio & Bowen, P.A.

(57) ABSTRACT

A T-step hull form for monohull planing vessels includes a forward section, an aft section, a transom, a step, and a skeg. The step is transversely oriented and separates the forward section from the aft section, and the skeg extends longitudinally along the length of the hull form from the step rearwardly to the transom, dividing the aft section into a starboard tunnel portion and a port tunnel portion. The starboard and port tunnel portions are ventilated at their respective outboard sides, at the transom, or both. Vents may pass transversely through the skeg. Tunnel flaps may be disposed in each of the tunnel portions and are hingeably attached at the step to allow for adjustability of the step's geometry. The addition of the skeg, which extends from the step to the transom, provides additional longitudinal surface area for the hull form, and in turn increases lateral stability.

8 Claims, 5 Drawing Sheets

T-STEP HULL FORM FOR MONOHULL PLANING VESSELS

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention generally relates to vessel hulls and more specifically to a T-step hull form for mono-hull planing vessels.

2. Description of Related Art

Conventional stepped hulls are relatively well-known in the art of planing vessel hull forms and are useful in mono-hull designs (as compared to catamaran or trimaran designs). These hulls include one or more steps, or "breaks" in the hull, which are intended to reduce the amount of hull surface that comes in contact with the water. By reducing water contact, friction resistance is reduced leading to faster overall speed capability for a given vessel. Conventional stepped hull designs include a step that runs across the entire width (or "beam") of the vessel, which step is usually located toward the back half of the hull. The step results in large apertures or gaps on the sides of the hull which provides ventilation for the hull.

These conventional stepped hull designs can result in a speed increase of about 10 to 15 percent for a given engine power output as compared to a non-stepped design. The speed increase occurs because the wetted area (i.e. the surface area of the hull that is in contact with water) is divided into smaller areas, each having a larger beam as compared to the length (i.e. larger aspect ratio). Lift generation is simply more efficient with a larger beam-to-length aspect ratio. Accordingly, with a stepped design, the hull can plane (i.e. achieve hydrodynamic lift) more efficiently on two or three high-aspect ratio surfaces rather than a single low-aspect ratio surface. In order for the increase in lift to occur over two or more high-aspect ratio surfaces, the rear of each step must be ventilated; this allows airs to be continuously sucked into the step region. Often, steps are ventilated to the outboard sides, at the transom, or both. Generally speaking, a stepped hull design allows for the adoption of lower output engine for a given set of desired performance characteristics, leading to an overall reduction in cost of the vessel and an increase in fuel efficiency. To that end, the cost of engines is often the largest single cost in recreational vessels and therefore if smaller engines can be used while still meeting desired performance expectations, a significant advantage can be gained.

Despite the speed benefits, conventional stepped hull designs are known to reduce stability, particularly at high speeds. This is because lift is spread laterally across more than one surface, which increases longitudinal stability, making it more difficult to trim the vessel. Without proper trimming, conventional stepped hull vessels can tend to swap ends and/or broach, i.e. become air-borne, while maneuvering. Stability can be achieved through the effective use of trim tabs (i.e. adjustable flaps fitted to the hull at the transom which correct/change the center of gravity of the vessel), but properly adjusting the tabs "on the fly" requires a boater with advanced knowledge and experience. Consequently, high speed maneuvering of stepped hull vessels can be quite dangerous, particularly for less-experiences boaters who are not proficient in setting the trim of the vessel. Further still, conventional stepped hull designs suffer from increased drag at low speeds, before higher speeds cause water to break cleanly off the step Several attempts at providing stepped hull designs are relatively well-known in the art; however, none are specifically designed to improve handling and stability characteristics, particularly during high speed maneuvering:

For example, U.S. Pat. No. 1,832,862 to Grumman relates to a hull design for a seaplane or amphibian aircraft designed to reduce suction of the water during takeoff. The hull includes a stepped rearward section having a diminutive keel running the length of the hull. The design provides for an upwardly sloped rearward section to keep the surface clear of the water leaving the step. A triangular flat bottom section is located at the apex of the bend of the keel, at the step, and facilitates early take off from a body of water.

U.S. Pat. No. 5,111,767 to Haines describes a boat hull having a flat, recessed section intersecting the transom along with a vent means and drain for ventilating an internal hollow body or reservoir mounted within the hull. The recessed section extends only partially along the beam of the hull, on either side of the centerline (keel) thereof and vents only rearward to the transom. The keel of the hull is completely interrupted at the recess. The venting body and recess prevents water from gaining access to the hull interior, trapping and expelling such water through the transom.

U.S. Pat. No. 5,191,853 to Adler describes a stepped hydroplane hull wherein the aft section has a positive trim angle and a forward portion has either a flat or positive trim angle wherein the angle of the forward portion is less than that of the aft portion. The hull also includes a region immediately aft of the step which is ventilated to atmosphere by air passages joining the step above the water line, in order to reduce drag at pre-planing speeds when the step is completely immersed in water. The air passages are not longitudinally placed and ventilation actually occurs through the hull. As with traditional stepped hull designs, the keel of the hull is stepped as well, decreasing handling stability at high speeds.

Japanese Patent No. JP6-227478 to Yamashita describes a hull design having a forward stepped section, a longitudinally oriented keel, a transverse hydrofoil, and catamaran-like side hulls. The hull results in a main center hull stabilized by smaller demihulls with a hydrofoil connecting the demihulls, with the hydrofoil generating planing lift.

Russian Patent No. RU2161105 describes a high speed ship hull having a stepped recess in an internal section of the hull, and substantially flanged sidewalls. The forward portion of the hull has one or more air distributor holes. The stepped section does not extend to the chines of the hull and thus the hull does not ventilate at the sides of the vessel. Further, the keel is stepped along with the stepped section, limiting high speed handling stability.

Consequently, there is a marked need for a stepped hull design that provides increased speed characteristics and efficiency benefits as compared to traditional mono-hull designs, while also providing greatly improved stability and handling characteristics as compared to known stepped hull designs. It is, therefore, to the effective resolution of the aforementioned problems and shortcomings of the prior art that the present invention is directed. However, in view of the heat exchanger systems in existence at the time of the present invention, it was not obvious to those persons of ordinary skill in the pertinent art as to how the identified needs could be fulfilled in an advantageous manner.

SUMMARY OF THE INVENTION

The present invention contemplates a T-step hull form for monohull planing vessels providing optimal speed and handling characteristics. In some embodiments, the hull form comprises a forward section, an aft section, a transom, a step, and a skeg. The step is transversely oriented across the hull and separates the forward section from the aft section. The skeg extends along the length of the hull form from the step rearwardly to the transom, dividing the aft section into a starboard portion and a port portion. The starboard and port portions are ventilated at their respective outboard sides, at the transom, or both. In some embodiments, one or more vents pass transversely through the skeg. The forward section of the hull form may also have one or more spray rails along its profile. The hull form, in some embodiments, further includes tunnel flaps disposed in each of the tunnel portions and are hingeably attached at said step. The flaps are configured to articulate to modify the geometry of the step, depending on the operating speed of the vessel.

The addition of the skeg, which extends from the step to the transom, provides additional longitudinal surface area for the hull form, and in turn increases lateral stability. Accordingly, the hull form of the present invention provides the speed benefits of a stepped hull design while improving lateral stability and overall maneuvering capabilities, particularly during high speed tracking and turning. The width of the skeg can be varied as desired, it being appreciated that a wider skeg provides more surface area, further improving the vessel's lateral stability and handling.

Accordingly, it is an object of the present invention to provide a novel hull form design well-suited for monohull planing vessels.

It is another object of the present invention to provide a stepped hull form design having a skeg extending from the step to the transom in order to increase the longitudinal surface area of the hull form.

It is another object of the present invention to provide a hull form that has the speed benefits of a stepped hull design while offering improved handling and maneuverability characteristics.

In accordance with these and other objects which will become apparent hereinafter, the instant invention will now be described with particular reference to the accompanying drawings.

DETAILED DESCRIPTION

Figure 1:
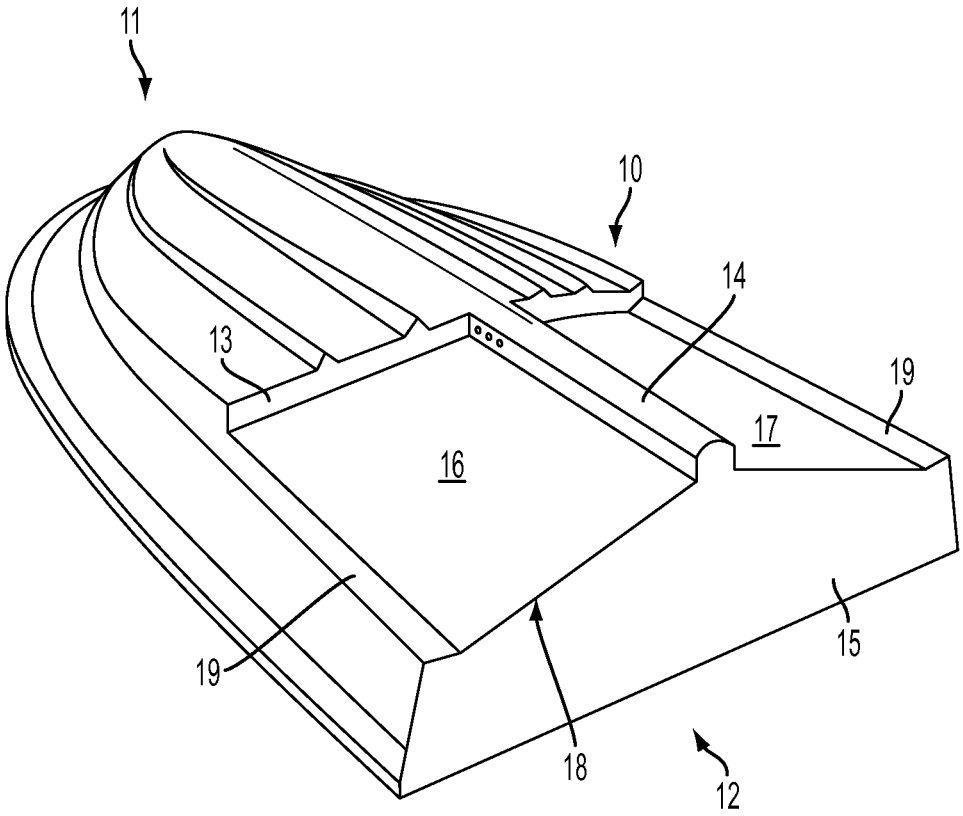
FIG. 1 is a perspective view of one embodiment of the T-step hull form of the present invention.

With reference to FIG. 1, a perspective view of one embodiment of the t-step hullform is shown. As shown, hull form 10 is configured as substantially v-shaped monohull having a forward section 11 and an aft section 12 separated by step 13. Step 13 is oriented substantially transverse with respect to hull form 10. Skeg 14 extends along the length of the hull form 10, from step 13 rearwardly to the transom 15, dividing aft section 12 into a starboard tunnel portion 16 and a port tunnel portion 17. Accordingly, with skeg 14 integrated into and extending substantially perpendicular from step 13, a T-shaped step, or "T-step" hull form is defined. In some embodiments, starboard tunnel portion 16 and port tunnel portion 17 are both ventilated at their respective outboard sides as well as rearward at the transom 15. Starboard tunnel portion 16 and port tunnel portion 17 extend to the chine 18 of hull form 10, and, in some embodiments, the outboard boundary 19 of both portions have a flatter angle with respect to the remainder of each portion. Additionally, with reference to FIG. 2, one or more vents 110 may pass transversely through skeg 14. As shown, in some embodiments, the vents 110 are located substantially forward, nearest to step 13, but they could be located elsewhere along the profile of skeg 14, as desired. Vents 110 assure that both the starboard tunnel portion 16 and port tunnel portion 17 remain ventilated in various sea conditions, including relatively rough conditions, which may otherwise impede outboard or rearward (transom) ventilation.

In some embodiments, forward section 11 of hull form 10 may include one or more spray rails 111 which run longitudinally along the profile of forward section 11, mirroring the curvature of the section. Spray rails 111 have the effect of deflecting water outwardly and away from the vessel during operation.

High speed handling characteristics and overall stability are greatly improved with the instant T-step design because, with skeg 14 extending from step 13 to transom 15, the entire keel section of the hull (which is not stepped) has no breaks in its profile. This continuation of the keel (i.e. skeg 14), which is not present in other stepped hull designs, allows the outboard sections of the hull, i.e. starboard tunnel portion 16 and port tunnel portion 17, to be ventilated as if the entire hull were stepped, while also leaving a larger longitudinal surface area in the water. The increased longitudinal surface area, by way of skeg 14, increases lateral stability and prevents the vessel from losing is maneuvering stability, particularly while tracking and/or turning at high speeds. In sum, the hull form of the present invention provides the speed benefits of a stepped hull design, while greatly improving handling and maneuverability as compared to conventional stepped hull designs.

Figure 2:
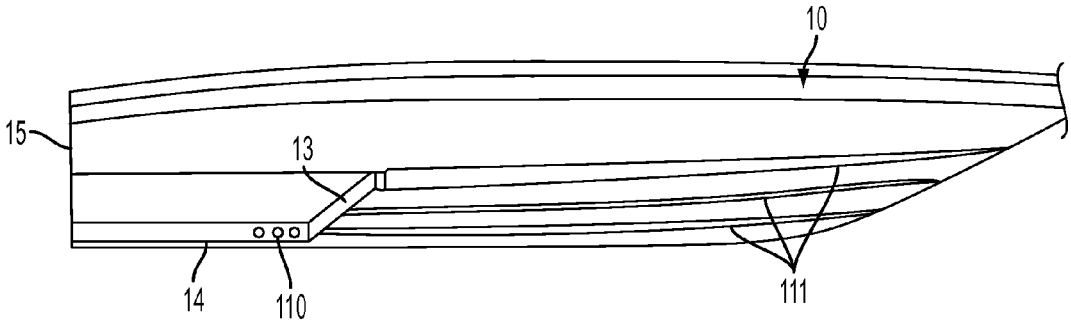
FIG. 2 is a side view of one embodiment of the T-step hull form of the present invention.
Figure 3:
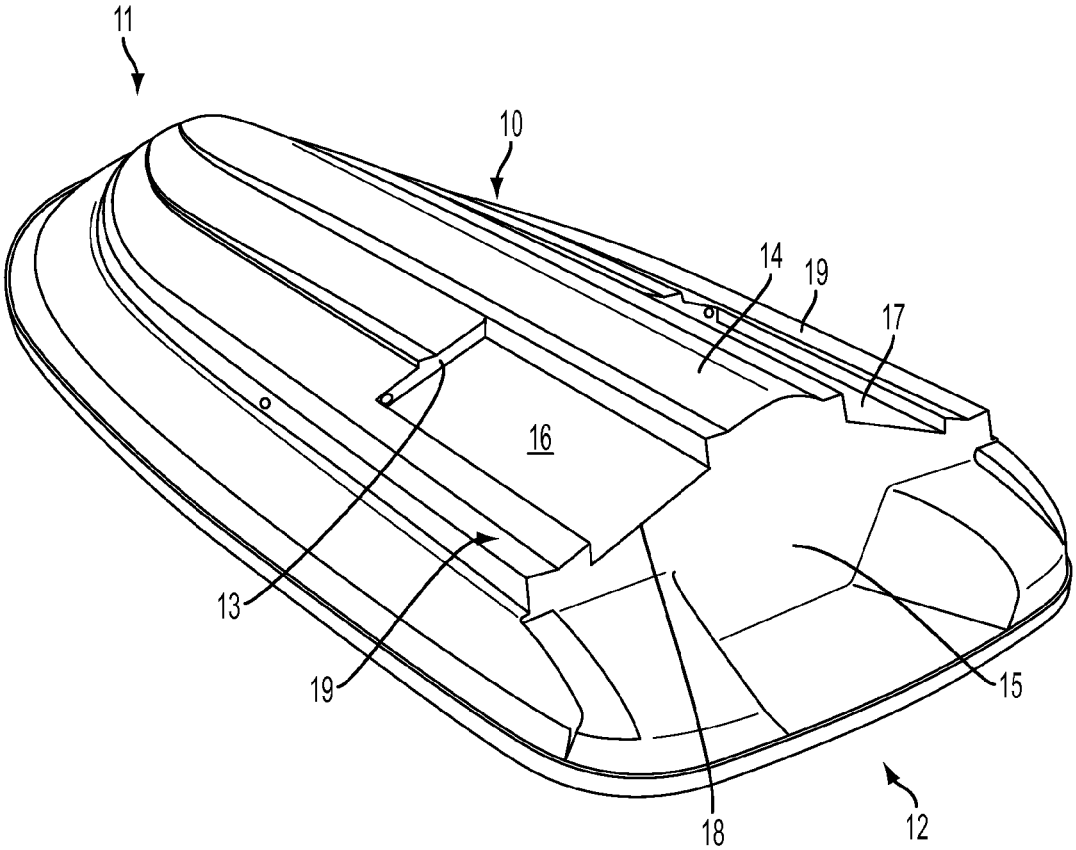
FIG. 3 is a rear perspective view of another embodiment of the T-step hull form of the present invention.
Figure 4A:
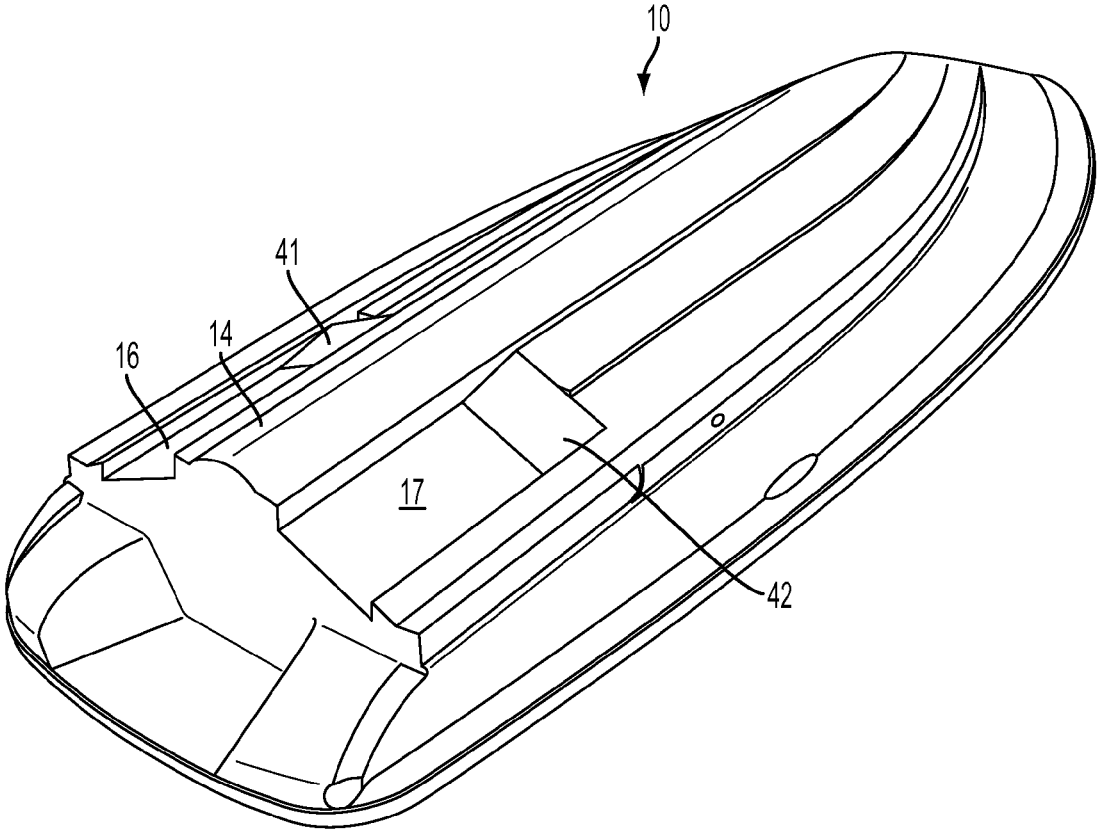
FIG. 4*a* is a rear perspective view of another embodiment of the T-step hull form of the present invention having flaps.
Figure 4B:
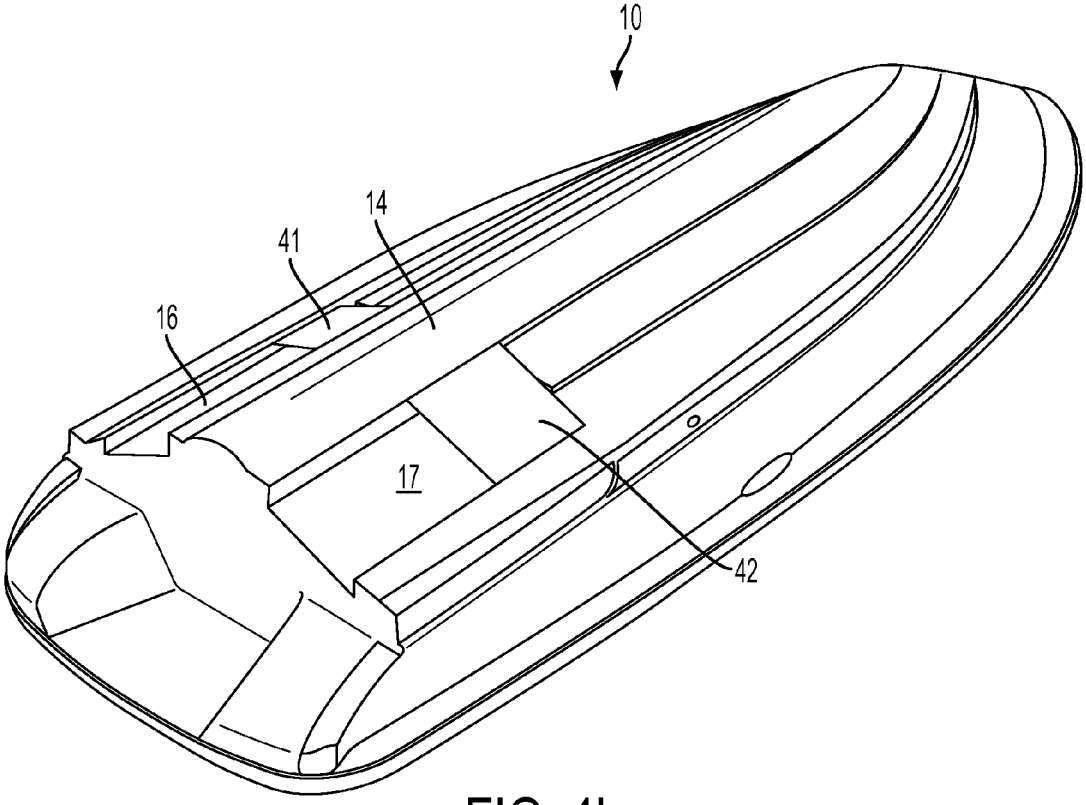
FIG. 4*b* is another rear perspective view of another embodiment of the T-step hull form of the present invention having flaps.

FIGS. 3-4B depict another embodiment of the present invention having many of the features and characteristics of the embodiments shown in FIGS. 1-2 including hull form 10 having a forward section 11 and an aft section 12 separated by a step 13. Step 13 is oriented substantially transverse with respect to hull form 10. Skeg 14 extends along the length of the hull form 10, from step 13 rearwardly to the transom 15, dividing aft section 12 into a starboard tunnel portion 16 and a port tunnel portion 17. Accordingly, with skeg 14 integrated into and extending substantially perpendicular from step 13, a T-shaped step, or "T-step" hull form is defined. In some embodiments, starboard tunnel portion 16 and port tunnel portion 17 are both ventilated at rearward at the transom 15. Thus, starboard tunnel portion 16 and port tunnel portion 17 extend to the chine 18 of hull form 10. In this embodiment, however, the outboard boundary 19 of the tunnel portions 16 and 17 are substantially closed. It is appreciated that the skeg 14 in this embodiment is somewhat wider than the skeg 14 shown in FIGS. 1-2, however this is a matter of design choice.

With a wider skeg 14, stability and handling characteristics and high speeds will be improved; however the speed enhancements provided by the stepped design may not be as drastic.

FIGS. 4A-4B depict hullform 10 having another aspect to improve the performance characteristics of the present invention. In some embodiments, hingeably attached to the forward boundary 40 of the tunnel portions 16 and 17, at step 13, are tunnel flaps 41 and 42, respectively. Tunnel flaps 41 and 42 are configured to pivotably articulate within their respective tunnel portions 16 and 17 through a plurality of orientations. In some embodiments, the tunnel flaps 41 and 42 are controlled by hydraulic, electric, or other similar means and may be automatically controlled for adjustment to optimize the shape of the hull form 10 during varying operating speeds. For example, below the speed range at which a conventional step reduces drag, the flaps create ramp away from the step 13 to eliminate the low speed drag penalty associated with a step. This is shown in FIG. 4A, whereby the flaps sharply angle downward from step 13 into the tunnel portions 16 and 17. At high speeds at which the step 13 can effectively reduce the wetted surface area of the hull form 10, the flaps 42 are lowered, creating a more drastic step feature as shown in FIG. 4B.

As noted above, the tunnel portions 16 and 17 may be ventilated to atmosphere rearwardly at the transom 15/chine 18, which allows the hull form 10 to more quickly achieve separation of flow. The flaps 41 and 42 may be configured to be automatically controlled or manually controlled an may operate within an extended range of motion to provide a plurality of hull form 10 geometries depending on the orientation of the flaps. Accordingly, the flaps control the severity, i.e. depth and angle, of the step 13 and will allow the hull form 10 to reduce its drag for slow speed operation while providing the speed enhancements of a fully stepped hull at higher speeds. It is appreciated that the flaps can be adjusted "on the fly" to provide a plurality of step 13 geometries. In combination with the stabilizing skeg 14 that extends longitudinally along the length of the hull form 10, overall performance, handling, and speed characteristics can be improved, leading to reduced power requirements, reduced cost, an overall improved boating experience.

It is appreciated that that the longitudinal (forward/aft) location of step 13 and the width of skeg 14 may vary from vessel to vessel depending on design needs. To that end, increasing the width of skeg 14 will increase the longitudinal surface area and in turn increase lateral stability, improving high speed maneuverability. The other relative dimensions of the constituent parts of the hull form 10 can vary as desired depending on overall vessel size and desired handling characteristics. The figures herein, therefore, should be only considered exemplary and are not limiting.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A hull form for a vessel, comprising:

a forward section, an aft section, a transom, a step, and a skeg;

said step transversely oriented and separating said forward section from said aft section;

said skeg extending longitudinally along a length of said hull form from said step rearwardly to said transom, dividing said aft section into a starboard tunnel portion and a port tunnel portion; and said skeg including a bottom surface and opposing generally vertical surfaces, said opposing vertical surfaces constituting longitudinally oriented steps dividing said aft section.

2. The hull form of claim 1, wherein an outboard side of each of said starboard tunnel portion and said port tunnel portion are ventilated.

3. The hull form of claim 1, wherein each of said starboard tunnel portion and said port tunnel portion are ventilated at said transom.

4. The hull form of claim 1, further comprising one or more vents passing transversely through said skeg.

5. The hull form of claim 4, wherein said one or more vents are located substantially near said step.

6. The hull form of claim 1, further comprising one or more spray rails disposed longitudinally on said forward section.

7. The hull form of claim 1, wherein and increasing a width of said skeg provides increased lateral stability for said vessel.

8. The hull form of claim 1, further including a tunnel flap disposed in each of said starboard tunnel portion and said port tunnel portion and hingeably attached at said step, said flap configured to articulate to modify the geometry of said step.

* * * * *